United States Patent [19]

Nakanaga

[11] Patent Number: 4,661,672

[45] Date of Patent: Apr. 28, 1987

[54] CONTAINER FOR USE IN HEATING BY MICROWAVE OVEN

[75] Inventor: Ryusuke Nakanaga, Takatsuki, Japan

[73] Assignee: House Food Industrial Company, Limited, Higashiosaka, Japan

[21] Appl. No.: 815,802

[22] Filed: Jan. 2, 1986

[30] Foreign Application Priority Data

Jan. 14, 1985 [JP] Japan ..... 60-4609

[51] Int. Cl.[4] ..... H05B 6/80

[52] U.S. Cl. ..... 219/10.55 E; 219/10.55 F; 426/243; 99/DIG. 14

[58] Field of Search ..... 219/10.55 E, 10.55 F, 219/10.55 D; 426/234, 243, 107; 126/390; 99/DIG. 14, 451

[56] References Cited

U.S. PATENT DOCUMENTS 2,600,566 6/1952 Moffett, Jr. ..... 219/10.55 E
2,612,596 9/1952 Gross ..... 219/10.55 F X
4,413,167 11/1983 Martel et al. ..... 219/10.55 E
4,425,368 1/1984 Watkins ..... 219/10.55 E X
4,486,640 12/1984 Bowen et al. ..... 219/10.55 F X
4,495,392 1/1985 Derby ..... 219/10.55 E

*Primary Examiner*—Philip H. Leung
*Attorney, Agent, or Firm*—Oblon, Fisher, Spivak, McClelland & Maier

[57] ABSTRACT

A container for use in heating by a microwave oven which is capable of preventing hardening and drying of the corners of the contents, and of allowing its contents to be uniformly and effectively heated. Referring to FIG. 1, the container of the present invention comprises an oblong container proper 1, a device 3 for elevating the container proper 1, a lid 5 and a microwave shielding layer 4. The container is characterized in that the container proper 1 is elevated above a microwave oven table 10 by a prescribed interval and a microwave shielding layer 4 covers both the upper side of the contents 2 and at least the upper half of the side walls on the short side of the container proper 1 when the lid 5is put thereon.

16 Claims, 7 Drawing Figures

CONTAINER FOR USE IN HEATING BY MICROWAVE OVEN

BACKGROUND OF THE INVENTION (1) Field of the Invention

The present invention relates to a container for use in heating by a microwave oven. The container is particularly adapted for use in cooking (i.e., baking or steaming) foods such as bread, cake and the like.

(2) Description of the Prior Art

Microwave ovens are widely used in commercial and industrial fields as well as in homes for various purposes including the heating and cooking of foods, since, with the microwave oven, a container having a lower heat resistance can be used than those required for heating by a gas range or oven, the time required for heating is very short, the contents are not burned, and operation is simple. Various types of instant foods have, thereofore, been marketed which are capable of being reheated or cooked by a microwave oven.

However, in heating by a microwave oven, the degree of irradiation with microwaves varies at different parts of the food being heated so that, for example, the upper surface and corners of the food may be heated by greater irradiation of microwaves than other parts, while other parts, for example, the bottom of the food, may be insufficiently heated because of receiving little irradiation by microwaves. As a result, the food is not heated uniformly. In particular, where bread or cake are baked or steamed by a microwave oven, uniform heating is hindered convection of the contents does not occur. In addition, since an oblong container is usually used for bread or cake, the portion of the material near the side wall on the short side of the container is over-heated so that water included in such portion is vaporized. As a result, this portion becomes hard and dry. The resulting cake or bread has poor taste and appearance. Accordingly, when the bread or cake is cut along a short side in the usual method, the texture, taste and appearance will vary within each slice. As the portion of the cake near the top of the container proper is also over-heated, the degree of heating is also different between the top and bottom portions of the slice. At the same tiime, the degree of rising of the bread or cake is low because the portion near the top of the container proper is hardened by heating before the content has sufficiently risen. As a result, the conventional cooking method is not good, particularly whe applied to baking or steaming breads and cakes.

Therefore, various improvements for inhibiting local over-heating in microwave oven cooking have been devised. For example, Japanese Utility Model Publication No. 2362/1976 discloses a container for a Japanese dish known as "chawanmushi" in which a metallic film is provided either on the external surface or on the internal surface of a lid so as to reflect microwaves, and in which a resistant film is also provided on the bottom of the container for absorbing microwaves. However, the container has a problem in that its side wall becomes over-heated when the container is heated for a long time during cooking.

Japanese Utility Model Public Disclosure (KOKAI) NO. 189795/1983 and Japanese Patent Public Disclosure (KOKAI) No. 32261/1981 also propose a food package having a microwave shielding member provided on the side surface of a package. This package is effective in holding down over-heating of the side wall.

On the other hand, however, over-heating of the upper portion thereof cannot be inhibited and, moreover, the heating efficiency is lowered.

Furthermore, the specification of Japanese Patent Public Disclosure (KOKAI) No. 126743/1979 discloses covering the periphery of food with a metallic foil selected in accordance with the speed at which the food is to be heated, but it does not disclose a means elevating the container proper above the microwave oven table. Accordingly, the temperature of the content locally rises, and there is a possibility of sparking during cooking in a microwave oven. Accordingly, the above-mentioned method is not appropriate for baking or steaming cake or bread.

SUMMARY OF THE INVENTION

Under such circumstances, the present inventors made various studies and found that a combination of two means, (1) provision of a microwave shielding layer in such manner that it covers both the upper surface and the side walls on the short sides of the container and (2) elevating the container proper above the microwave oven table by a prescribed distance, is the most effective way of inhibiting hardening and drying of the portions near the side walls on the short sides of the container and of the portion near top surface of the container because heat is effectively transferred and local heating is not caused by the passage of the microwaves into the contents of the container from the directions of the side walls on the long sides of the container and of the bottom of the container.

OBJECTS OF THE INVENTION

It is, therefore, a primary object of the present invention to provide a container for use in heating by a microwave oven which is capable of preventing hardening and drying of corners of the contents, and of allowing the contents to be uniformly and effectively heated.

Another object of this invention is to provide an inexpensive container for use in effective heating by a microwave oven.

Another object of this invention is to provide a convenient container for baking or steaming food such as bread and cake by a microwave oven.

These and other objects of this invention will be clear from the following description.

In accordance with the present invention, there is provided a container for use in heating by a microwave oven comprising an oblong container proper for holding contents to be heated and cooked; means for elevating the contents from the microwave oven table by a prescribed interval; and a microwave shielding layer which covers both the upper side of the contents and at least the upper half of the side walls on the short side of the container proper.

DESCRIPTION OF THE PREFERRED EMBODIMENTS

Figure 4:
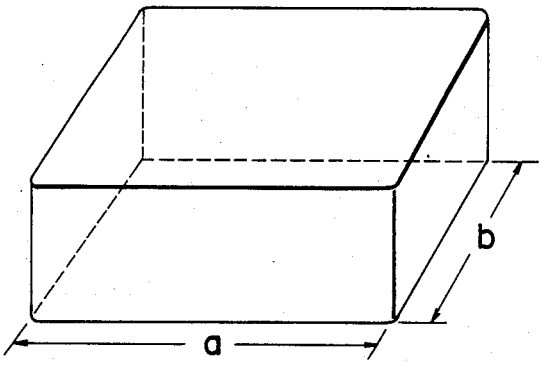
FIGS. 4 to 6 are views showing the shapes of various containers according to the invention.
Figure 5:
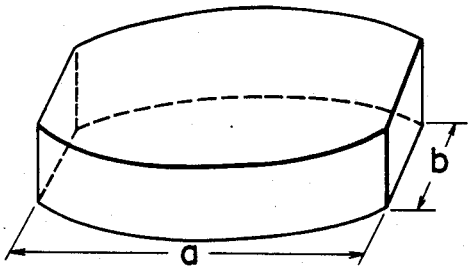
Figure 6:
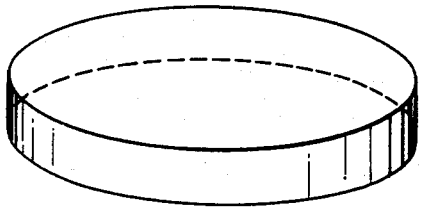
Figure 7:
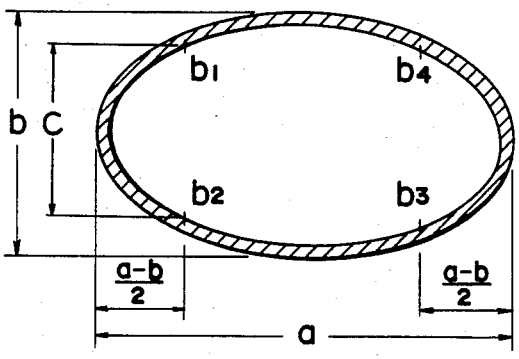
FIG. 7 is a transverse sectional view of the container of FIG. 6.

The container proper of the present invention in which the contents are charged is oblong. In the present invention, the concept of "oblong" includes, for example, the ellipsoid shape as shown in FIG. 5 as well as the case in which the transverse sectional view of the container has a long side (a) and a short side (b) as shown in FIG. 4. In the latter case, where the ratio of the length of (a) to that of (b) is not less than, 1.2:1, in particular not less than 1.45:1, the specific advantages of the present invention can be obtained. Furthermore, the oblong container of this invention includes a container whose side wall is formed as a curved surface as shown in FIG. 6 and a container which has the major part of its side walls formed as a curved surface. In this case, the transverse section of the container of FIG. 6 is as shown in FIG. 7, in which case it is preferable that the length (c) of the short sides are taken as $b_1$–$b_2$ and $b_3$–$b_4$ at positions inward from the opposite ends of the elipse by the distance (a-b)/2.

In order to provide an air space between the bottom of the container proper and a microwave oven table, means for elevating the container proper is provided on the container proper. The means is useful because it inhibits generation of spark between the microwave shielding layer and the microwave oven table, inhibits local rise of temperature, and prevents irradiation of microwaves from the bottom of the container proper. For the above reason, it is desired that the prescribed interval (h) be in the range of 2 to 45 mm, preferably 3 to 25 mm. In particular, the interval is preferably 3 to 15 mm where the microwave oven table is made of enamelware or metal, and it is preferably 3 to 9 mm where the table is made of glass. This means can be provided on the container proper by any method, so long as the interval is within the above-mentioned range. For example, the means can be directly provided on the bottom of the container proper, or an outer container can be provided outside of the container proper, i.e., the container can be formed as a double container.

The container proper for holding the contents and the means for elevating the container proper are made of a water resisting material which transmits microwaves and is sufficiently heat-resistent to withstand heating by a microwave oven (i.e., does not melt at least up to 100° C.). These materials include polyethylene, polypropylene, polycarbonate, polyester, nylon, paper and paper coated with any of these polymers. Where the double container is employed as the container of the present invention, it is more effective if the outer container is made of a thermal insulating material such as polystyrene foam because this provides excellent heat retaining properties. The container may in advance be filled with a product in a solid, paste or liquid form or as a mixture thereof and then be hermetically sealed by a lid integrally formed with the container. In this connection, the lid of the container may alternatively be formed so as to be removable so that the lid may be taken off and water, milk, egg or the like or a mixture of two or more of these can be poured over the contents prior to cooking. In particular, it is desirable that a removable lid be put on the top of the container proper and also folding pieces turning toward the inside of the container be provided on the upper edge of the container proper. This is because by this means there can be obtained some advantages in that the bread or cake will not overflow the container by its expansion during baking or steaming and in that the lid will more upward following the expansion of the bread or cake so that the upper portion thereof will be soft.

In the container of this invention, a microwave shielding layer is provided in such manner that it covers the upper side of the contents and at least the upper half and preferably all of the side walls on the short sides of the container proper. The microwave shielding layer may be formed of a metallic material which does not transmit microwaves such as aluminum, nickel, chromium, iron, zinc, tin or any alloy made from these metals. For providing the microwave shielding layer at the above-mentioned position, a metallic thin film may be bonded or laminated to such position. In this connection, the microwave shielding layer may be provided on either the inner or the external surface of the side wall of the container. The microwave shielding layer need not necessarily be provided in such manner that it covers the entire upper side of the contents side, but it is preferable that no less than one-forth of the area of the upper side of the contents be covered where this container is applied for baking or steaming cake. It is also preferable to cover no less than three-fourths of the area of the upper side of the contents with the microwave shielding layer where this container is applied for cooking a steamed bread, because this allows the steamed bread to become tender and spongy. In this connection, the microwave shielding layer covering the upper side of the contents is preferably positioned in such manner that the corners of the upper surface of the contents are covered in order to more effectively inhibit local heating.

According to the present invention, bread mix or cake mix are charged in the oblong container and is then heated by microwaves from the bottom and side walls on long sides of the container so that effective heating is conducted. In addition, it is preferable to provide the microwave shielding layer on the upper portion of the side walls on the long sides of the container, i.e., at the portion where the upper surface of the contents contacts the side walls on the long sides of the container, as this inhibits local heating at the upper surface of the contents. As a rule, about one-fourth from the top of the side walls of the container is covered with the microwave shielding layer. One or more apertures for escape of vapor can be also privided in the upper portion of the container.

The basic structure of the container of the present invention is as described above, but the container can be modified within the scope of the present invention.

Embodiments of the present invention will now be described hereinunder with the reference to the accompanying drawings.

Figure 1:
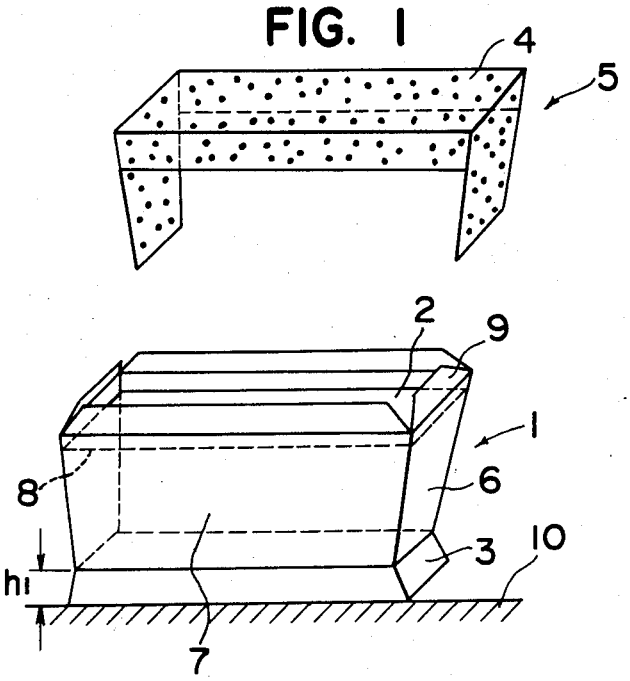
FIGS. 1 and 2 are views of a container of the invention with the lid removed.

In FIG. 1, which is a view of the container of the present invention with the lid off, the contents 2 are shown in the container proper 1. Means 3 for elevating the container proper 1 is united with the bottom of the container proper 1, whereby the contents 2 are elevated from the microwave oven table 10 ($h_1$=8 mm). In this case, the container proper 1 and the means 3 are made of a paper coated with polypropylene. The side walls 6 on the short sides of the container proper 1, the upper portion of the side walls on the long sides of the container proper 1, and the upper side of the contents 2 are covered with the microwave shielding layer by overhanging a lid 5 having a microwave shielding layer 4 made of aluminum foil on the container proper 1. In this container, therefore, the position 8 at which the upper surface of the contents 2 contacts the side walls of the long side of the container proper 1 is covered with the microwave shielding layer 4. Folding pieces 9 turning toward the inside of the container proper 1 are also provided on the upper edge of the container proper 1, and the lid 5 is fitted onto the container proper 1.

Steamed bread mix comprising wheat flour, sugar, baking powder, powdered fat and oil, and the like together with a sauce mix comprising sugar, water, thickening agent, flavoring and the like were charged into the container proper of FIG. 1, and they were then thoroughly agitated and mixed. The lid was then put on the container and the container was exposed to microwave irradiation for three and half minutes in 600 w a microwave oven. As a result, there was obtained a steamed bread that was tender and spongy and exhibited a uniform appearance, texture and taste. On the other hand, a pound cake baked using the container of FIG. 1 showed no unevenness in baking.

Figure 2:
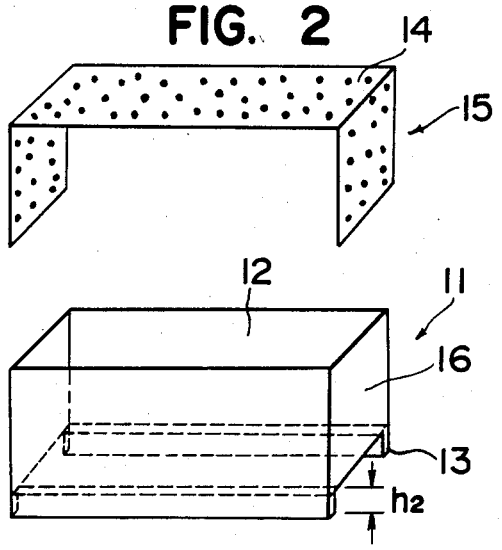

FIG. 2 is a view of another embodiment of the container of the present invention with the lid 15 off. The lid 15 can be fitted onto the container proper 11 in sliding manner. A container proper 11 and a means 13 united to the container proper 11 for elevating the container proper 11 are made of a paper coated with polypropylene. The contents 12 are held elevated above the oven table by a prescribed distance ($h_2=5$ mm). A microwave shielding layer made of alminium foil is provided on the removable lid 15 and covers only the side walls 16 of the short sides of the container proper 11 and the upper portion of the container proper 11.

Figure 3:
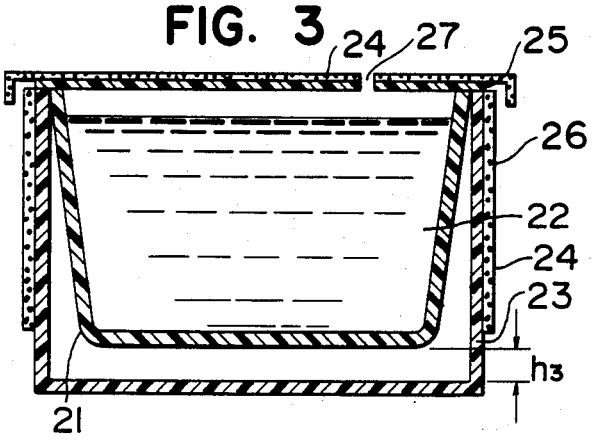
FIG. 3 is a longitudinal sectional view taken substantially along the long side of a container of the invention.

FIG. 3 shows a longitudinal sectional view taken substantially along the long side of another embodiment of a container of the present invention. The contents 22 are charged in the container proper 21, which is made of polypropylene, and an outer container 23 formed of polystyrene foam is provided as a means for elevating the container proper above the oven table by a prescribed distance ($h_3=8$ mm). In this case, a lid 25 laminated with a microwave shielding layer made of aluminum foil is positioned above the upper side of the contents 22. A microwave layer 24 is also provided on the side walls 26 on the short sides of the outer container 24. The layer 24 does not, however, cover the side walls on the long sides of the outer container 24. One or more apertures 27 for escape of vapor are provided in the lid 25.

As is obvious from the above description, according to the present invention, hardening and drying of the contents at the upper surface and the regions in contact with the side walls on the short sides of the container can be inhibited, so that bread or cake of consistently good and uniform quality can be easily obtained at home. Moreover, whereas it takes about 30 minutes to make steamed bread according to the tradiational method, it is possible according to the present invention to make it in three and half minutes. Furthermore, the container of the present invention can also be used as a packaging container for bread mix or cake mix, which is very convenient since the packaging container can also be used as the container for baking or steaming the bread or cake.

What is claimed is:

1. A container for use in heating by a microwave oven, said container comprising:

(a) an oblong container proper for holding contents to be heated and cooled, said oblong container proper having two short side walls, two long side walls, a bottom, and a top;

(b) means for elevating said container proper from a microwave oven table by an interval of 2 to 45 mm; and (c) a microwave shielding layer which covers both said top of said container proper and at least the upper half of said two short side walls of said container proper, (d) wherein said bottom of said container proper and said means:

(i) are made of a water resisting material that transmits microwaves and (ii) are not covered by said microwave shielding layer.

2. A container as set forth in claim 1 wherein said means is provided on said bottom of said container proper.

3. A container as set forth in claim 1 wherein said container comprises a lid on which said microwave shielding layer is provided.

4. A container as set forth in claim 3 wherein said lid is fitted on said container proper in a sliding manner.

5. A container as set forth in claim 3 wherein said lid has one or more apertures for escape of vapor.

6. A container as set forth in claim 3 wherein said microwave shielding layer is provided on said lid in such manner that it covers both said top of said container proper and at least the upper half of said two short side walls of said container proper.

7. A container as set forth in claim 1 wherein said microwave shielding layer is provided to entirely cover said two short side walls of said container proper.

8. A container as set forth in claim 1 wherein said microwave shielding layer is provided on the upper region of said two long side walls of said container proper.

9. A container as set forth in claim 1 wherein holding pieces turning toward the inside of said container proper provided on an upper edge of said container proper.

10. A container as set forth in claim 1 wherein said container is a double continer.

11. A container as set forth in claim 1 wherein the ratio of the length of said two long side walls to the length of said two short side walls is not less than 1.2 to 1.

12. A container as set forth in claim 11 wherein the ratio of the length of said two long side walls to the length of said two short side walls is not less than 1.45 to 1.

13. A container as set forth in claim 1 wherein said means elevates said container proper by an interval of 3 to 25 mm.

14. A container as set forth in claim 13 wherein said means elevates said container proper by an interval of 3 to 15 mm.

15. A container as set forth in claim 14 wherein said means elevates said container proper by an interval of 3 to 9 mm.

16. A container as set forth in claim 1 wherein said microwave shielding layer does not cover at least the lower half of said two long side walls.

* * * * *